US006986694B2

(12) United States Patent
Chung

(10) Patent No.: US 6,986,694 B2
(45) Date of Patent: Jan. 17, 2006

(54) METHOD FOR REMOVING IMPURITIES OF PLASMA DISPLAY PANEL

(75) Inventor: Jae-Sang Chung, Seongnam (KR)

(73) Assignee: LG Electronics Inc., Seoul (KR)

( * ) Notice: Subject to any disclaimer, the term of this patent is extended or adjusted under 35 U.S.C. 154(b) by 169 days.

(21) Appl. No.: 10/331,978

(22) Filed: Dec. 31, 2002

(65) Prior Publication Data

US 2003/0141815 A1 Jul. 31, 2003

(30) Foreign Application Priority Data

Jan. 25, 2002 (KR) ..... 10-2002-0004477

(51) Int. Cl.
*H01J 9/38* (2006.01)
*H01J 9/00* (2006.01)

(52) U.S. Cl. ..... 445/59; 445/5; 445/6; 445/25

(58) Field of Classification Search ..... 445/5, 445/6, 24, 25, 59
See application file for complete search history.

(56) References Cited

U.S. PATENT DOCUMENTS 4,083,614 A * 4/1978 Aboelfotoh et al. ..... 445/25
6,479,944 B2 * 11/2002 Lee et al. ..... 313/582
2002/0146959 A1 * 10/2002 Park et al. ..... 445/25

FOREIGN PATENT DOCUMENTS

| | | | |
|---|---|---|---|
| JP | 01225127 A | * | 9/1989 |
| JP | 03-257739 | | 11/1991 |
| JP | 11-054038 A | | 2/1999 |
| JP | 2001-028241 | | 1/2001 |
| JP | 2002-025443 | | 1/2002 |
| JP | 2002025443 A | * | 1/2002 |
| WO | WO 2003043751 A1 | * | 5/2003 |

* cited by examiner

*Primary Examiner*—Mariceli Santiago
(74) *Attorney, Agent, or Firm*—Birch, Stewart, Kolasch & Birch, LLP

(57) ABSTRACT

In a method for removing impurities of a plasma display panel capable of shortening panel aging time by removing impurities of an upper and a lower substrates under vacuum gas circumstances, the method includes fabricating an upper substrate and a lower substrate; removing impurities of the upper and lower substrates by using at least one of a plasma-cleaning process in which a discharge is performed under vacuum gas circumstances and a heating process in which heating is performed; assembling the impurities removed upper and lower substrates; exhausting gas inside the assembled upper and lower substrates and injecting a discharge gas; and aging the discharge gas injected-plasma display panel.

26 Claims, 7 Drawing Sheets

METHOD FOR REMOVING IMPURITIES OF PLASMA DISPLAY PANEL

BACKGROUND OF THE INVENTION

1. Field of the Invention

The present invention relates to a plasma display panel, and in particular to a method for removing impurities of a plasma display panel which is capable of shortening a panel aging time.

2. Description of the Prior Art

In general, according to development and popularization of information processing system, importance of a display apparatus as a visual information transfer means has been increased.

In the conventional display apparatus, a CRT (cathode ray tube) is bulky and has an image distortion problem due to an earth magnetic field. In the meantime, recent various display apparatus aim for oversize, flatness, high brightness, high efficiency in screen. Accordingly, researches on various flat panel displays have been actively going on. For example, in the flat panel display, a LCD (liquid crystal display), a FED (field emission display) and a PDP (plasma display panel), etc. have been developed.

The PDP (plasma display panel) displays pictures including character or graphic by radiating fluorescent material by ultraviolet rays generated in discharge of a mixed gas such as He+Xe, Ne+Xe and He+Ne+Xe, etc. Thinning and scale-up of the PDP can be easily achieved. Because the PDP has a simple structure, it is easy to fabricate. In addition, it has a higher brightness and luminous efficiency in comparison with other flat panel displays. Because of those advantages, researches on PDP have been actively going on. In particular, in a three electrodes alternating current surface discharge type PDP, because wall electric charge is accumulated on the surface in discharge and electrodes are protected from sputtering in discharge, it is possible to perform a low voltage operation and have a long life span.

FIG. 1 is a sectional view illustrating discharge cells of a general three electrodes alternating current surface discharge type plasma display panel.

As depicted in FIG. 1, an upper panel includes an upper glass substrate 10; a sustain electrode 12 making a pair and formed at the bottom surface of the upper glass substrate 10; a dielectric layer 14 for maintaining surface electric charge in discharge of the sustain electrode 12; and a protecting film 16 for protecting the dielectric layer 14 from discharge.

In addition, a lower panel includes a lower glass substrate 26; an address electrode 22 formed at the top surface of the lower glass substrate 26; a lower dielectric layer 24 formed at the whole top surface of the address electrode 22; a separation wall 20 formed at the top surface of the lower dielectric layer 24 in parallel with the address electrode 22; and a fluorescent material 18 coated onto the separation wall 20 and radiating visible rays by excitation of ultraviolet rays.

The fabrication process of the general three electrodes alternating current surface discharge type plasma display panel will be described.

The sustain electrodes 12 are arranged at the bottom surface of the upper glass substrate 10 in parallel. In more detail, the sustain electrode 12 consists of an ITO (indium tin oxide) electrode 12A and a bus electrode 12B which are pasted in Cr/Cu/Cr or silver (Ag). The sustain electrode 12 supplies a scan signal for address discharge and a sustain signal for sustain discharge. The dielectric layer 14 for electric, charge is coated onto the upper panel on which the sustain electrode 12 is arranged by a screen printing method, and a protecting film 16 is formed on the surface of the dielectric layer 14.

Herein, the protecting film 16 extends a life of the dielectric layer 14, improves secondary electron discharge efficiency and reduces discharge characteristics variation of fireproof metal due to oxide contamination by protecting the dielectric layer 14 from the sputtering phenomenon of plasma particles. A MgO (magnesium oxide) film is mainly used as the protecting film 16.

In addition, the fabrication method of the lower panel will be described.

In the lower panel, the address electrode 22 is formed by the screen printing method. The address electrode 22 supplies a data signal for address discharge. The lower dielectric layer 24 is formed at the top surface of the lower glass substrate 26 on which the address electrode 22 is formed. The separation wall 20 is formed on the top surface of the dielectric layer 12 on which the address electrode 22 is formed by the screen printing method or a sand blast method so as to be parallel with the address electrode 22. In more detail, the separation wall 20 provides a discharge space inside the discharge cells in order to cut off electrical and optical interference between discharge cells and performs a function for supporting the upper panel and the lower panel.

The fluorescent material 18 for generating visible rays is formed onto the surface of the lower dielectric layer 24 in which the address electrode 22 is formed and the separation wall 20 by the screen printing method.

Afterward, the fabrication of the three electrodes alternating current surface discharge type PDP is completed through the processes shown in FIG. 2.

FIG. 2 is a flow chart illustrating the fabrication processes of the general alternating current surface discharge type PDP.

First, the upper panel and the lower panel are fabricated as shown at step ST1. Second, in an assembling process, seal agent is coated onto the upper panel and the lower panel, and they are temporarily fixed. Afterward, the temporarily fixed upper panel and lower panel are put into a calcining furnace, are heated at about 450° C. as a melting point of the seal agent, and accordingly the upper panel and lower panel are adhered to each other as shown at step ST2. Third, in an exhausting and discharge gas-injecting process, the internal portion of the adhered upper and lower panels is vacuumized, and several mg inert gas as a mixed gas of Ne, Xe, He, etc. is injected therein as shown at step ST3. Last, a panel aging process is performed as shown at step ST4. In the panel aging process, to prevent driving voltage increase and luminous stain phenomenon due to contamination and oxidation, etc. on the surface of the electrodes occurred in the panel fabrication process, the electrode surface (namely, insulating layer) is uniformed so as to get good discharge characteristics and reduce a driving voltage. In addition, the panel aging process is for examining condemned panel in the early stage by applying an appropriate voltage to a panel or securing reliability of a panel through device voltage stabilization, a time required for the panel aging process is about 24 hours.

However, in mass production of the PDP, the panel aging process causes a bottle neck phenomenon in which lots of time and cost are consumed, and accordingly a PDP device production time and cost may increase.

SUMMARY OF THE INVENTION

In order to solve the above-mentioned problem, it is an object of the present invention to provide a method for removing impurities of a PDP (plasma display panel) which is capable of reducing a panel aging time by removing impurities on an upper panel and a lower panel under vacuum gas circumstances.

In order to achieve the above-mentioned object, a method for removing impurities of a PDP (plasma display panel) in accordance with the present invention includes fabricating an upper substrate and a lower substrate; and removing impurities of the upper and lower substrates by using at least one of a cleaning process in which discharge is performed under vacuum gas circumstances and a heating process in which heating is performed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
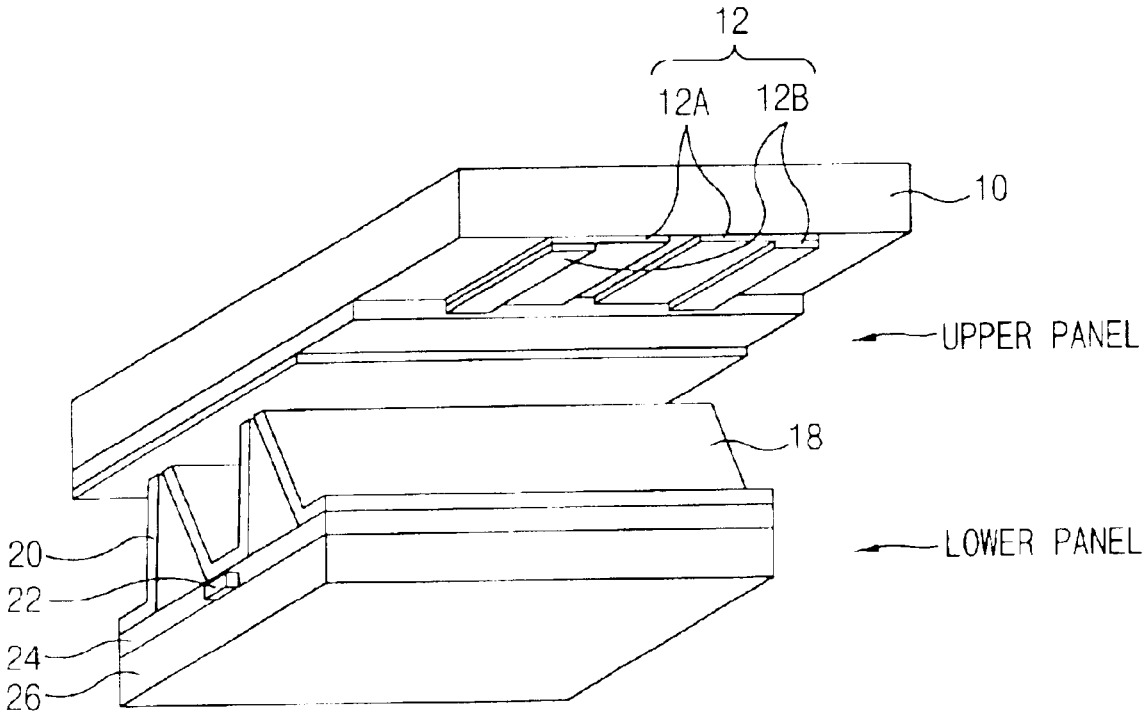
FIG. 1 CONVENTIONAL ART
FIG. 1 is a sectional view illustrating discharge cells of a general three electrodes alternating current surface discharge type plasma display panel.
Figure 2:
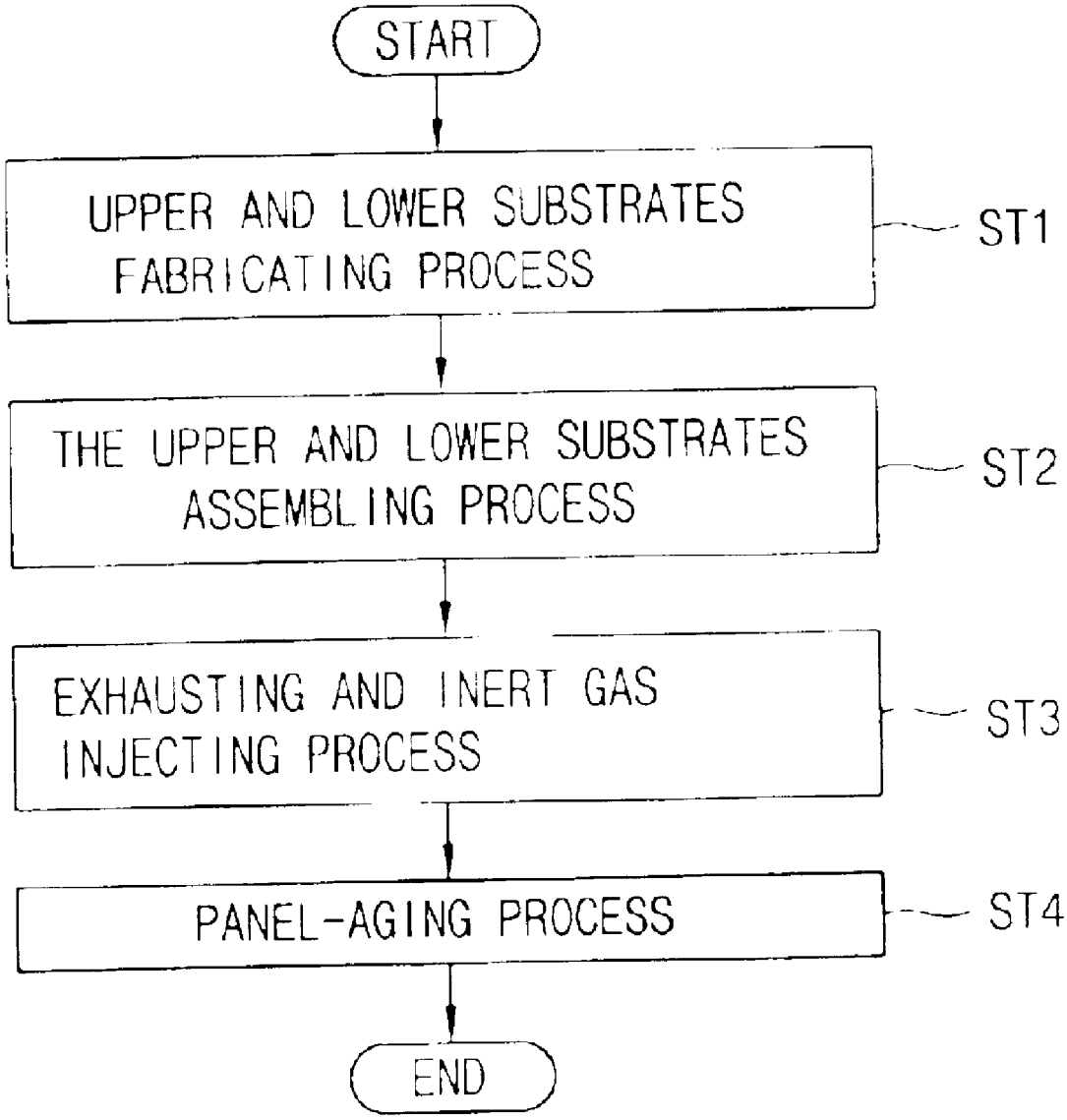
FIG. 2 CONVENTIONAL ART
FIG. 2 is a flow chart illustrating fabrication processes of the general alternating current surface discharge type PDP.
Figure 3:
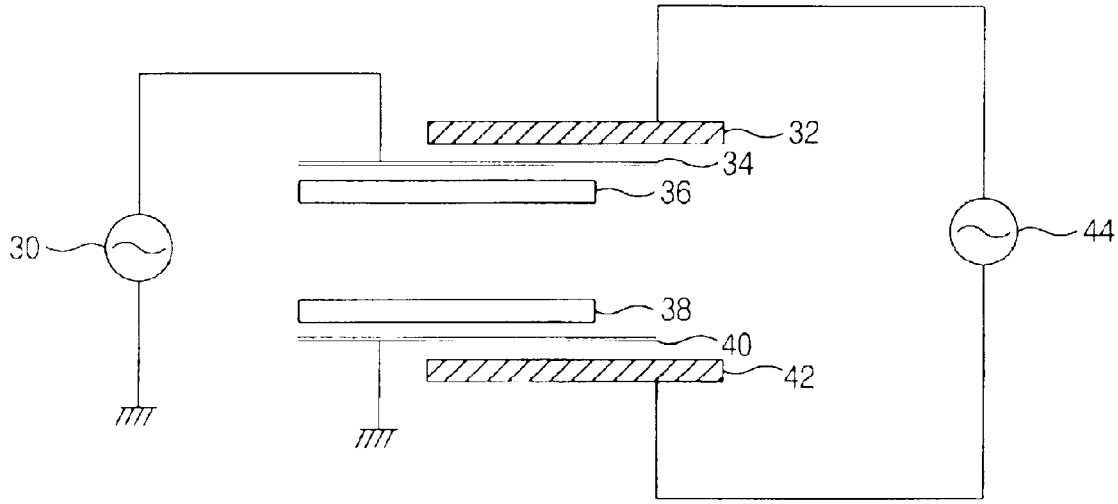
FIG. 3 is an exemplary view illustrating an apparatus for removing impurities of a PDP (plasma display panel) in accordance with the present invention.

FIG. 3 is an exemplary view illustrating an apparatus for removing impurities of a PDP (plasma display panel) in accordance with the present invention.

As depicted in FIG. 3, an apparatus for removing impurities consists of a plasma-cleaning unit and a heating unit.

The plasma-cleaning unit includes a RF (radio frequency) supply power source 30; a first flat plate electrode 34 installed so as to face the top surface of an upper substrate 36 and contact to the RF power supply source 30; and a second flat plate electrode 40 installed so as to face the bottom surface of a lower substrate 38 and contact to a GND (ground).

The heating unit includes an alternating current power supply source 44; and heaters 32, 42 installed so as to face the top surface of the first flat plate electrode 34 and the bottom surface of the second flat plate electrode 40 respectively and contact the alternating current power supply source 44. Herein, the heaters 32, 42 are for heating the upper substrate 36 and the lower substrate 38.

Hereinafter, a method for removing impurities of a PDP (plasma display panel) in accordance with the present invention will be described.

Figure 4:
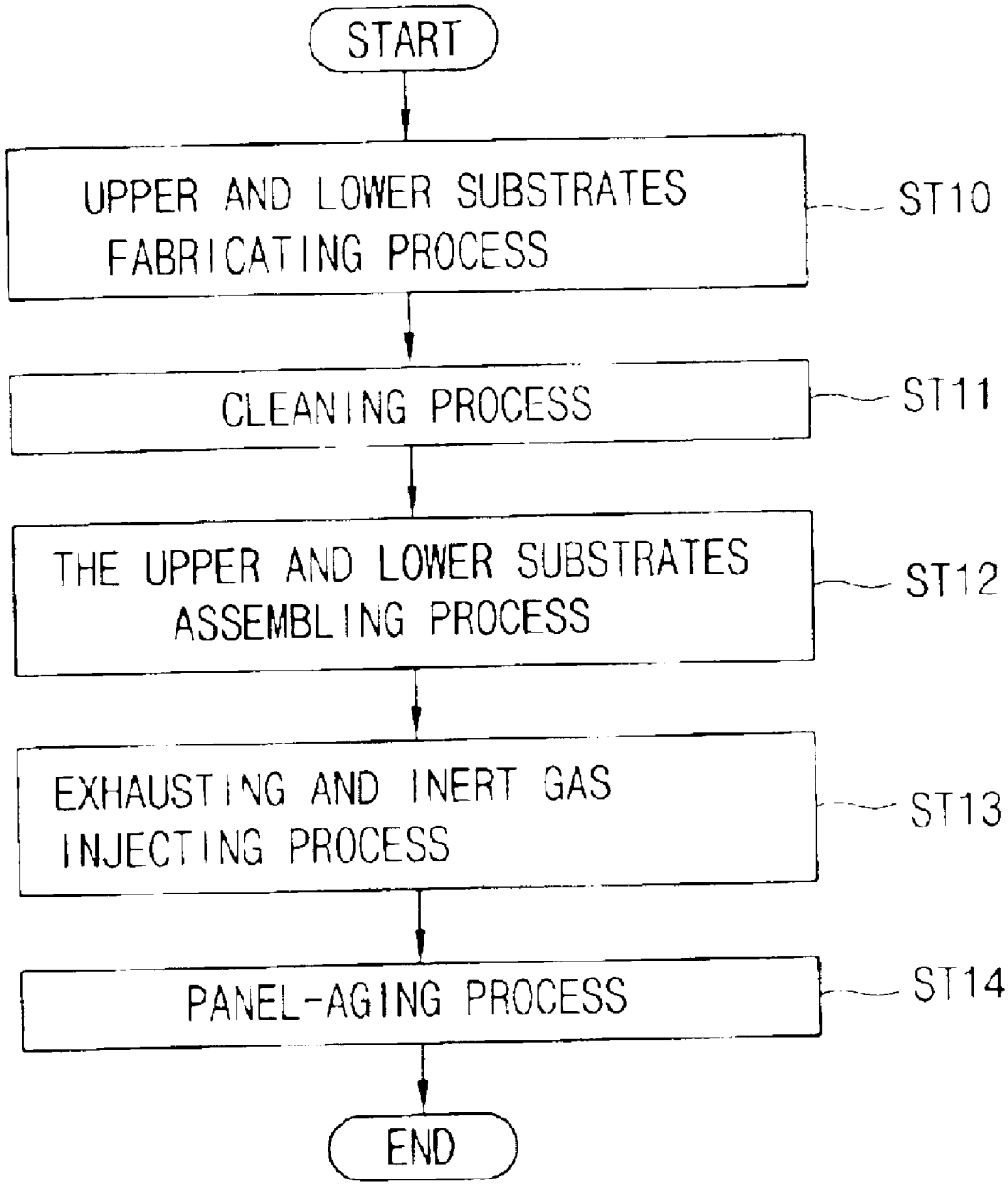
FIG. 4 is a flow chart illustrating a method for removing impurities of a PDP (plasma display panel) in accordance with the present invention.

FIG. 4 is a flow chart illustrating the method for removing impurities of a PDP (plasma display panel) in accordance with the present invention.

As depicted in FIG. 4, the method includes fabricating the upper and lower substrates 36, 38 as shown at step ST10; removing impurities of the upper and lower substrates by using at least one of a plasma-cleaning process or a heating process as shown at ST 11; assembling the upper and lower substrates 36, 38 as shown at ST 12; exhausting gas inside the assembled upper and lower substrates 36, 38 and injecting a discharge gas as shown at step ST13; and aging the discharge gas injected-plasma display panel as shown at step ST14.

The method for removing impurities of the PDP (plasma display panel) will be described in more detail.

Because the upper and lower substrates 36, 38 are fabricated by the same process with the conventional art, detailed description about that will be abridged.

After fabricating the upper and lower substrates 36, 38 as shown at step ST10, the process of removing impurities of the upper and lower substrates by using at least one of a plasma-cleaning process or a heating process is performed.

In order to perform the cleaning process, the RF plower supply source 30 supplies a radio frequency in MHz and preferably, 13.56 MHz to the first flat plate electrode 34. Accordingly, plasma discharge occurs under inert gas circumstances between the upper substrate 36 installed on the first flat plate electrode 34 and the lower substrate 38 installed on the second flat plate electrode 40. According to that, a protecting film of the upper substrate 36 and the surface of a fluorescent material of the lower substrate 38 are appropriately cleaned by positive ions of gas.

Afterward, in order to perform the heating process, the alternating current power supply source 44 supplies alternating current to the heaters 32, 42, each heater 32, 42 heats the upper and lower substrates 36, 38 in vacuum respectively, and accordingly impurities are removed. Herein, the heating process can be simultaneously performed with the plasma-cleaning process in order to remove impurities more efficiently, improve a reaction speed, improve flatness and maintain a uniformity, etc. of the substrates or only the heating process can be performed for the above-mentioned effects.

The plasma-cleaning process and heating process of the cleaning process are performed under conditions shown in Table 1.

TABLE 1

| Item | CONDITIONS |
|---|---|
| Basic Pressure | $10^{-7}$ Torr~$10^{-6}$ Torr |
| Plasma Power | RF (13.56 MHz) |
| Processing Pressure | Several mTorr~several Torr |
| Distance between Electrodes | Several tens mm~several hundreds mm |
| Processing Gas | Inert gas (He, Ne, Ar, Kr, Xe) |
| Heating Time | Several min~several tens min |
| Heating Temperature | Several ° C.~several hundreds ° C. |

Figure 5:
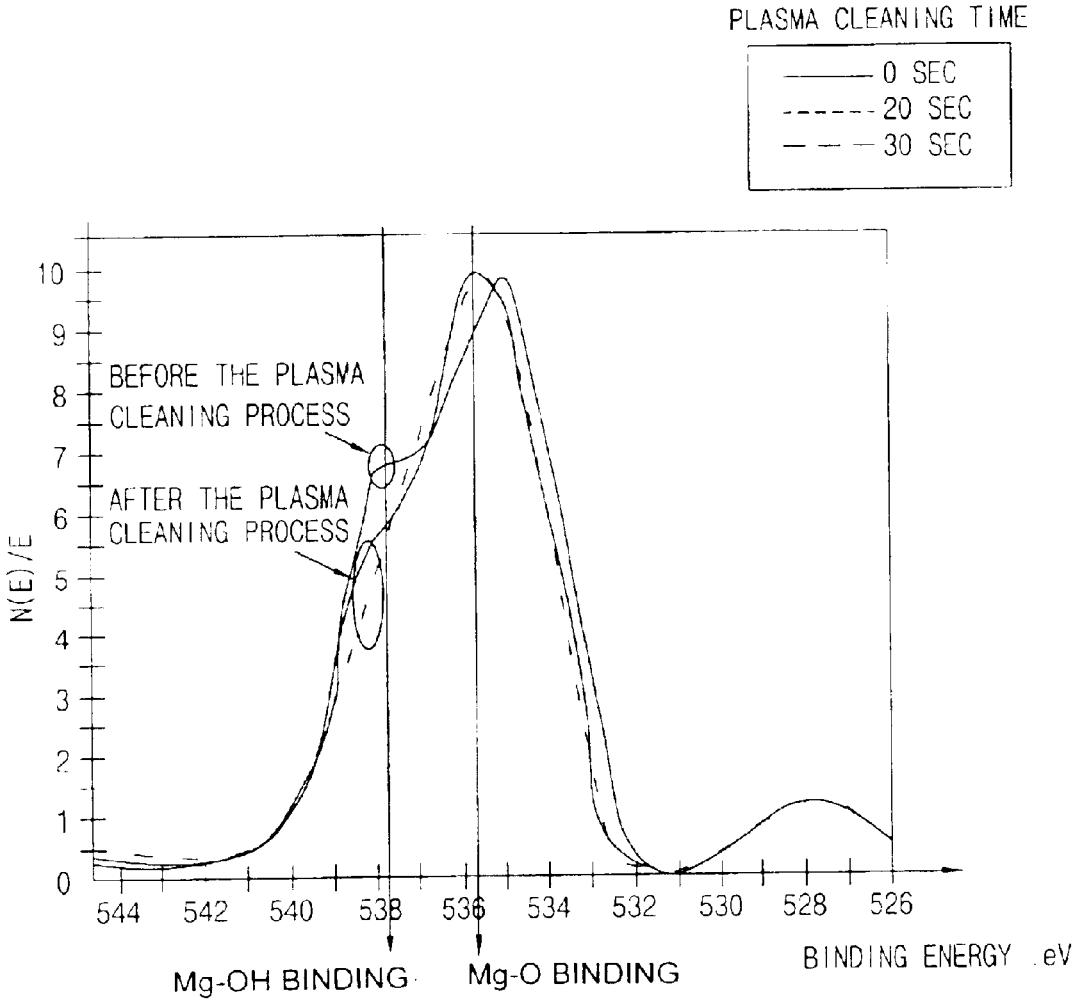
FIG. 5 is a graph illustrating chemical variation of a protecting film according to a plasma cleaning process analyzed by a X-ray photoelectron spectroscopy.

FIG. 5 is a graph illustrating chemical variation of the protecting film according to the plasma-cleaning process analyzed by a X-ray photoelectron spectroscopy.

As depicted in FIG. 5, in the plasma-cleaning process, Mg—OH peak combined with a magnesium oxide (MgO)

protecting layer 12 due to impurities ($H_2O$) existing on the surface thereon is almost removed. In addition, binding energy is lowered in comparison with the conventional art.

Figure 6:
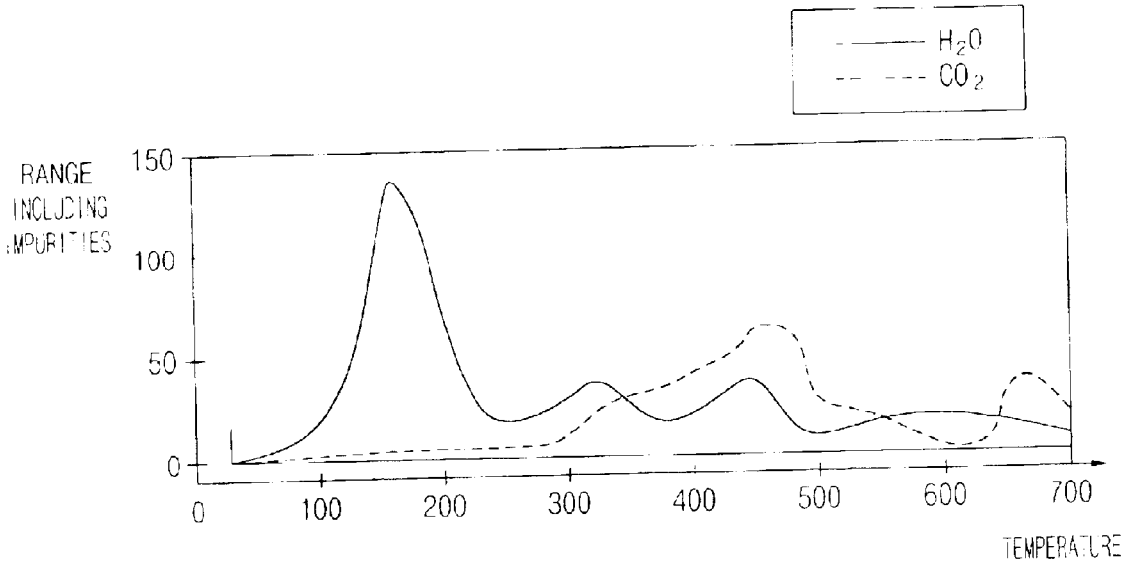
FIG. 6 is a graph illustrating a TPD (temperature programmed desorption) curve of fluorescent material according to a heating process in accordance with the present invention.

FIG. 6 is a graph illustrating a TPD (temperature programmed desorption) curve of the fluorescent material according to the heating process in accordance with the present invention.

As depicted in FIG. 6, by the heating process, $H_2O$ as impurities of the fluorescent material is almost removed at a temperature about 130° C., and $CO_2$ is almost removed at a temperature about 430° C. Namely, impurities are removed within a temperature as several hundreds ° C.

Afterward, the upper and lower substrates 36, 38 cleaned through the plasma-cleaning process and/or the heating process are assembled.

In the assembling process, positions of the seal agent coated-upper substrate 36 and the lower substrate 38 are fixed, and they are assembled temporarily. Herein, the positions are determined in the accuracy, flatness and parallelism aspects by an image processing technique. Afterward, the temporarily assembled upper and lower substrates 36, 38 are put into a calcining furnace, are heated at about 450° C. as a melting point of the seal agent, and accordingly the upper and lower substrates 36, 38 are adhered to each other.

In an exhausting and discharge gas injecting process, the inner portion of the adhered upper and lower substrates 36, 38 is vacuumized, and several mg of an inert gas as a mixed gas of Ne, Xe, He, etc. is injected therein.

Last, a panel aging process is performed by applying a certain frequency to the electrodes of the upper and lower substrates 36, 38 and generating discharge.

Figure 7:
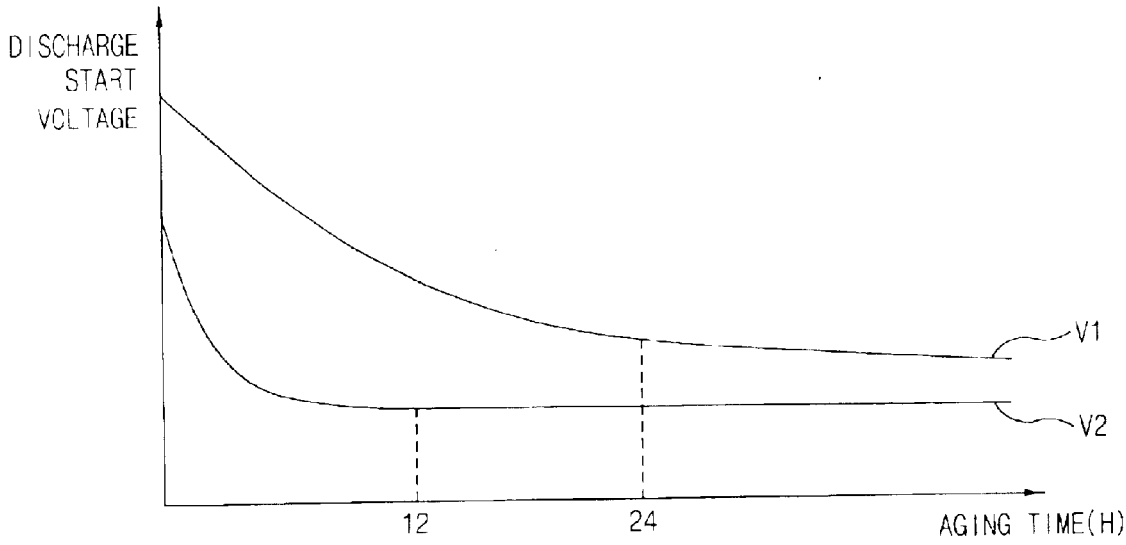
FIG. 7 is a graph illustrating relation between a discharge start voltage and a time in a PDP fabricated through a plasma cleaning process in accordance with the present invention in comparison with the conventional art.

In comparison with the conventional art, FIG. 7 is a graph illustrating relation between a discharge start voltage and a time in the PDP fabricated through the plasma-cleaning process in accordance with the present invention.

As depicted in FIG. 7, V1 shows a relation between an aging time and a discharge voltage in the conventional art, and V2 shows a relation between an aging time and a discharge voltage in the method in accordance with the present invention. Herein, on the X-axis indicating time and the Y-axis indicating a discharge voltage, V1 is a discharge start voltage in the conventional art, V2 is a discharge start voltage of the PDP in accordance with the present invention, and V2 shows remarkable difference. For example, in the conventional art, it is possible to remove $H_2O$ as a representative contamination source almost from the surface by performing the panel aging process for about 24 hours. However, in the present invention, it is possible to remove $H_2O$ as a representative contamination source almost from the surface by performing the panel aging process for about 12 hours with a comparatively low discharge voltage. Accordingly, by shortening an aging time of the PDP from 24 hours to 12 hours, a production time and cost can be reduced.

As described above, in the present invention, impurities on the upper and lower substrates can be removed by performing at least one of the plasma-cleaning process in which discharge is performed under vacuum gas circumstances and the heating process in which heating is performed, and accordingly it is possible to reduce a panel aging time. According to that, a production time and cost of a PDP device can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for removing impurities of a plasma display panel, comprising:

fabricating an upper substrate and a lower substrate; and removing impurities of the upper and lower substrates by using a heating process in which heating is performed, wherein the heating process includes the steps of:

installing a first heater to face the top surface of the upper substrate and installing a second heater to face the bottom surface of the lower substrate; and connecting an alternating current supply source to the first and second heaters.

2. The method of claim 1, wherein said step of removing impurities of the upper and lower substrates also includes using a cleaning process in which discharge is performed under vacuum gas circumstances, wherein the cleaning process includes the steps of:

installing a first flat plate electrode to face the upper surface of the upper substrate and installing a second flat plate electrode to face the bottom surface of the lower substrate; and discharging with the installed electrodes under vacuum gas circumstances.

3. The method of claim 2, wherein a RF (radio frequency) power supply source for supplying a radio frequency in a MHz and, is connected to the first flat plate electrode, and a ground power terminal is connected to the second flat plate electrode.

4. The method of claim 3, wherein the RF (radio frequency) power supply source supplies a radio frequency at approximately 13.56 MHz.

5. The method of claim 2, wherein the first heater is located to face the top surface of the first flat plate electrode and the second heater is located to face the bottom surface of the second flat plate electrode.

6. The method of claim 2, further comprising:

assembling the upper and lower substrates;

exhausting gas inside the assembled upper and lower substrates and injecting a discharge gas; and aging the discharge gas injected-plasma display panel.

7. The method of claim 6, wherein the internal portion of the assembled upper and lower panels is vacuumized, and an inert gas is injected therein in the exhausting and injecting process.

8. The method of claim 6, wherein discharge is performed by applying a certain frequency voltage to the electrodes of the assembled upper and lower substrates in the aging process.

9. The method of claim 6, wherein a time required for the aging process is not greater than 12 hours.

10. The method of claim 1, wherein the first and second heaters are heated to a temperature of at least 130 degrees Celsius.

11. The method of claim 10, wherein the first and second heaters are heated to a temperature of at least 430 degrees Celsius.

12. The method of claim 1, wherein plasma discharge is performed by using an inert gas.

13. The method of claim 12, wherein the inert gas is selected from Ne, Xe, He, Ar or Kr.

14. The method of claim 1, wherein the process of removing impurities is performed under a basic pressure of $10^{-7}$ Torr~$10^{31\ 6}$ Torr.

15. The method of claim 1, wherein the process of removing impurities is performed under a processing pressure.

16. The method of claim 1, wherein the process of removing impurities is performed between electrodes.

17. The method of claim 16, wherein the electrodes are space from each other by a distance of 10 mm~100 mm.

18. The method of claim 1, wherein the process of removing impurities is performed for at least 1 min.

19. The method of claim 18, wherein the process of removing impurities is performed for 1 to 10 minutes.

20. A method for removing impurities of a plasma display panel, comprising:

fabricating an upper substrate and a lower substrate;

removing impurities of the upper and lower substrates by using a plasma-cleaning process in which a discharge is performed under vacuum gas circumstances, wherein the plasma-cleaning process includes the steps of:

installing a first flat plate electrode to face the upper substrate and installing a second flat plate electrode to face the lower substrate; and discharging with the installed electrodes under vacuum gas circumstances, and wherein a RF (radio frequency) power supply source is connected to the first flat plate electrode, and a ground power terminal is connected to the second flat plate electrode.

21. The method of claim 20, wherein the upper and lower substrates are heated.

22. The method of claim 21, wherein the upper and lower substrates are heated to a temperature of at least 130 degrees Celsius.

23. The method of claim 20, wherein the process of removing impurities is performed under a basic pressure of $10^{-7}$ Torr~$10^{-6}$ Torr.

24. The method of claim 20, further comprising the steps of:

assembling the upper and lower substrates, after the impurities are removed;

exhausting gas inside the assembled upper and lower substrates and injecting a discharge gas; and aging the discharge gas injected-plasma display panel.

25. The method of claim 20, wherein the electrodes are space from each other by a distance of 10 mm ~100 mm.

26. The method of claim 20, wherein the process of removing impurities is performed for at least 1 minute.

* * * * *